US008206573B2

(12) United States Patent
Ohta et al.

(10) Patent No.: US 8,206,573 B2
(45) Date of Patent: Jun. 26, 2012

(54) ELECTRODE FOR ELECTROLYSIS AND METHOD FOR PRODUCING AQUEOUS SOLUTION OF QUATERNARY AMMONIUM HYDROXIDE USING THE SAME

(75) Inventors: Yoshiro Ohta, Kawasaki (JP); Toshitsura Cho, Kawasaki (JP)

(73) Assignee: Tama Chemicals Co., Ltd., Kawasaki (JP)

( * ) Notice: Subject to any disclaimer, the term of this patent is extended or adjusted under 35 U.S.C. 154(b) by 909 days.

(21) Appl. No.: 11/663,005

(22) PCT Filed: Sep. 8, 2005

(86) PCT No.: PCT/JP2005/016499

§ 371 (c)(1), (2), (4) Date: May 23, 2007

(87) PCT Pub. No.: WO2006/030685

PCT Pub. Date: Mar. 23, 2006

(65) Prior Publication Data

US 2008/0035491 A1 Feb. 14, 2008

(30) Foreign Application Priority Data

Sep. 17, 2004 (JP) ..... 2004-272413

(51) Int. Cl.
*C25B 1/00* (2006.01)

(52) U.S. Cl. ..... 205/551

(58) Field of Classification Search ..... 205/551
See application file for complete search history.

(56) References Cited

U.S. PATENT DOCUMENTS 4,484,999 A 11/1984 Asano et al.
4,634,509 A * 1/1987 Shimizu et al. ..... 204/541
4,765,879 A 8/1988 Matsumoto et al.

FOREIGN PATENT DOCUMENTS

EP 538955 A1 * 4/1993

OTHER PUBLICATIONS

Xiang et al., "Study on Modified IrO2 Electrode", Wujiyan Gongye (no month, 1998), vol. 30, No. 3, pp. 16-17 and 42. Abstract Only.*
Balko et al., "Iridium-Tin Mixed Oxide Anode Coatings", J. of Appl. Electrochem. (no month, 1991), vol. 21, pp. 678-682.*
English language abstract of JP 59-038394 (Mar. 2, 1984).
English language abstract of JP 04-254595 (Sep. 9, 1992).
English languaoe abstract of JP 2003-277965 (Oct. 2, 2003).
English language abstract of JP 03-271386 (Dec. 3, 1991).
English language abstract of JP 62-260086 (Nov. 12, 1987).

* cited by examiner

*Primary Examiner* — Edna Wong
(74) *Attorney, Agent, or Firm* — Birch, Stewart, Kolasch & Birch, LLP

(57) ABSTRACT

Provided is an electrode for electrolysis with excellent corrosion resistance and durability which can be used sustainably in the production of a high-purity quaternary ammonium hydroxide by the electrolysis of a quaternary ammonium inorganic acid salt in an electrolytic cell partitioned by a cation exchange membrane on a commercial scale with reduced electric power consumption at low cost. The electrode for electrolysis is useful for the production of a quaternary ammonium hydroxide by the electrolysis of a quaternary ammonium inorganic acid salt in an electrolytic cell partitioned by a cation exchange membrane and comprises an electrode base material of an electrically conductive metal, an electrode active layer containing an electrode active material covering the electrode base material, and an intermediate layer of a mixed oxide of an oxide of at least one kind of metal selected from In, Ir, Ta, Ti, Ru, and Nb and an oxide of Sn disposed between the electrode base material and the electrode active layer.

7 Claims, 1 Drawing Sheet

ELECTRODE FOR ELECTROLYSIS AND METHOD FOR PRODUCING AQUEOUS SOLUTION OF QUATERNARY AMMONIUM HYDROXIDE USING THE SAME

FIELD OF TECHNOLOGY

This invention relates to an electrode for electrolysis which is usable in the production of a quaternary ammonium hydroxide by electrolysis and to a method for producing an aqueous solution of a quaternary ammonium hydroxide by electrolysis using the said electrode for electrolysis as an anode.

BACKGROUND TECHNOLOGY

An aqueous solution of tetramethylammonium hydroxide (TMAH), one of the group of quaternary ammonium hydroxides, is currently used in large quantities as a developer of resist membranes in the manufacture of LSI's and liquid crystal displays, as a cleaning fluid for semiconductor substrates in one of the steps for the production of semiconductors, or as a raw material for tetramethylammonium silicate and it is an industrially irreplaceable compound. In particular, in the case where TMAH is used in the aforementioned applications relating to semiconductors, the requirements for the concentration of impurities in TMAH are very rigid; for example, transition metals, alkali metals, and alkaline earth metals such as Na, K, Ca, Cu, Zn, Fe, Cr, Ni, Pb, Ti, and Sn must respectively be kept below 1 ppb. For this reason, there is a demand for a method which is capable of producing an aqueous solution of high-purity TMAH on a commercial scale at low cost.

The inventors of this invention earlier proposed a method for producing TMAH which comprises synthesizing a quaternary ammonium inorganic acid salt by the reaction of a trialkylamine with a dialkyl carbonate and electrolyzing the inorganic salt in an electrolytic cell partitioned by a cation exchange membrane (refer to Patent Reference 1). This method is free from the problematical generation of halogen ions and formate ions which corrode electrodes and degrade ion exchange membranes in the course of electrolysis and is capable of producing high-purity TMAH with a reduced content of the aforementioned impurities and excellent storage stability and, additionally, in an enhanced yield.

In an electrolytic process involving electrode reactions, insoluble electrodes are generally used to avoid the consumption of the electrodes themselves. As the performance required for insoluble electrodes varies with the products and objects of electrolysis, insoluble electrodes are classified, for example, into electrodes for generation of chlorine, electrodes for generation of oxygen, and functional electrodes (electrodes coated with platinum group metals). According to the aforementioned method for producing TMAH proposed by the inventors of this invention, oxygen and carbon dioxide evolve from the anode in the electrolysis of a quaternary ammonium inorganic acid salt in an electrolytic cell partitioned by a cation exchange membrane as shown in FIG. 1. The solution of the quaternary ammonium inorganic acid salt shows a pH of approximately 8 to 10. Electrolysis of this kind has not often been observed.

Now, an electrode of a metal such as gold (Au), platinum (Pt), and silver (Ag), a graphite electrode, an electrode formed by plating an electrode base material of titanium with a platinum group metal, a lead electrode, a nickel electrode, an electrode formed by coating an electrode base material of titanium with oxides consisting mainly of an oxide of a platinum group metal, and the like are generally used in various electrolytic processes. However, the use of any of these electrodes as an anode in the production of TMAH by electrolysis in the aforementioned manner causes problems such as degradation of corrosion resistance and durability and a rise of electrolytic voltage to incur an increase in electric power consumption and an increase in production cost on a commercial scale. To be specific, when an electrode of gold (Au), platinum (Pt), or silver (Ag) or a graphite electrode is used, the surface of the electrode peels off and the voltage rises after only a few hours of electrolysis and this makes it difficult to continue the electrolysis. When an electrode formed by plating an electrode base material of titanium with a platinum group metal is used, costly metals such as Pt, Pd, and Ru dissolve out as impurities on the order of ppm after only a few hours of electrolysis. On the other hand, an electrode formed by coating an electrode base material of titanium with oxides of Ir and Ta is intended for use in an electrolytic process in which oxygen evolves from the anode during electrolysis and it is used mainly in electrolytic plating with the use of a sulfuric acid bath or the like. In consequence, when this electrode is used in the electrolysis of a quaternary ammonium inorganic acid salt where oxygen and carbon dioxide evolve from the anode, oxygen and carbon dioxide evolve simultaneously thereby causing problems such as a rise of overvoltage in electrolysis, degradation of the durability of electrode, and an increase in the electric power consumption. A lead electrode, a nickel electrode, or a graphite electrode exhibits durability and corrosion resistance to some extent as an anode in the electrolysis of organic alkaline compounds; however, when used in the kind of electrolysis proposed above by the inventors of this invention where oxygen and carbon dioxide evolve simultaneously, the electrode in question consumes itself excessively and cannot function as a commercially satisfactory electrode.

By the way, an electrode comprising an electrode base material of an electrically conductive metal, a coating of an electrode active material composed of a platinum group metal or an oxide covering the electrode base material, and an intermediate layer of a mixed oxide of an oxide of one kind or more of metals selected from Ti and Sn and an oxide of one kind or more of metals selected from Ta and Nb disposed between the electrode base material and the electrode active material is proposed (refer to Patent Reference 2). Another electrode whose intermediate layer comprises a first intermediate layer of a compound of a rare earth metal and a second intermediate layer of a base metal or an oxide thereof is proposed (refer to Patent Reference 3). However, both of these electrodes are intended for use in an electrolytic process in which oxygen and carbon dioxide evolve from the anode during electrolysis. Therefore, their use in the electrolysis of a quaternary ammonium inorganic acid salt in which oxygen and carbon dioxide evolve from the anode causes technical and economic problems such as a rise of overvoltage during electrolysis, degradation of durability and corrosion resistance, and an increase in electric power consumption.

Patent Reference 1: JP63-15355 B
Patent Reference 2: JP59-38394 A
Patent Reference 3: JP2-5830 B

DISCLOSURE OF THE INVENTION

Problems to be Solved by the Invention

Under the aforementioned circumstances, the inventors of this invention have conducted intensive studies on electrodes for electrolysis useful for the production of a high-purity quaternary ammonium hydroxide by the electrolysis of a quaternary ammonium inorganic acid salt in an electrolytic cell partitioned by a cation exchange membrane while aiming at developing electrodes which are capable of minimizing elution of impurity metals, showing excellent durability and corrosion resistance, and performing with low overvoltage and reduced electric power consumption, found that electrodes formed by coating an electrode base material first with a mixed oxide of an oxide of Sn and an oxide of the prescribed metal and then with an electrode active material are suitable for use in the aforementioned electrolysis of a quaternary ammonium inorganic acid salt, and completed this invention.

Accordingly, an object of this invention is to provide an electrode for electrolysis which shows excellent corrosion resistance and durability and is capable of performing over a prolonged period of time with reduced electric power consumption on a commercial scale at low cost in the production of a high-purity quaternary ammonium hydroxide by the electrolysis of a quaternary ammonium inorganic acid salt in an electrolytic cell partitioned by a cation exchange membrane.

Another object of this invention is to provide a method for producing an aqueous solution of a high-purity quaternary ammonium hydroxide commercially at low cost with as much reduction as possible of the elution of impurity metals.

Means to Solve the Problems

Thus, this invention relates to an electrode for electrolysis which is usable in the production of a quaternary ammonium hydroxide by the electrolysis of a quaternary ammonium inorganic acid salt in an electrolytic cell partitioned by a cation exchange membrane and comprises an electrode base material of an electrically conductive metal, an electrode active layer of a mixed oxide of an oxide of at least one kind of metal selected from In or Ir and an oxide of Sn covering the electrode base material, and an intermediate layer of a mixed oxide of an oxide of at least one kind of metal selected from In or Ir, and an oxide of Sn disposed between the electrode base material and the electrode active layer.

Further, this invention relates to a method for producing an aqueous solution of a quaternary ammonium hydroxide which comprises synthesizing a quaternary ammonium inorganic acid salt by the reaction of a trialkylamine with a dialkyl carbonate and electrolyzing the inorganic acid salt in an electrolytic cell partitioned by a cation exchange membrane using the aforementioned electrode for electrolysis as an anode.

Still further, this invention relates to a method for producing an electrode for electrolysis wherein said electrode for electrolysis is usable in the production of a quaternary ammonium hydroxide by the electrolysis of a quaternary ammonium inorganic acid salt in an electrolytic cell partitioned by a cation exchange membrane and comprises an electrode base material of an electrically conductive metal, an electrode active layer covering the electrode base material, and an intermediate layer disposed between the electrode base material and the electrode active layer and said method comprises applying an alcohol in which a chloride of at least one kind of metal selected from In or Ir, a chloride of Ta, and a chloride of Sn are dissolved to the surface of the electrode base material, drying and thermally decomposing, further applying an alcohol in which a chloride of at least one kind of metal selected from In or Ir and a chloride of Sn are dissolved, drying and thermally decomposing thereby forming the intermediate layer of a mixed oxide, then applying an alcohol in which a chloride of at least one kind of metal selected from In or Ir and a chloride of Sn are dissolved, and drying an thermally decomposing thereby forming the electrode active layer of a mixed oxide.

According to this invention, the method described in JP63-15355 B is preferably used for the production of a quaternary ammonium hydroxide by the electrolysis of a quaternary ammonium inorganic acid salt in an electrolytic cell partitioned by a cation exchange membrane. The quaternary ammonium inorganic acid salt to be electrolyzed in an electrolytic cell partitioned by a cation exchange membrane can be synthesized by the reaction of a trialkylamine with a dialkyl carbonate. The trialkylamines include trimethylamine $[(CH_3)_3N]$ and triethylamine $[(C_2H_5)_3N]$ while the dialkyl carbonates include dimethyl carbonate $[(CH_3)_2CO_3]$ and diethyl carbonate $[(C_2H_5)_2CO_3]$ and they are allowed to react in a solvent such as methyl alcohol and ethyl alcohol to give quaternary ammonium inorganic acid salts. The conditions for this reaction are suitably selected; for example, the reaction may be carried out at a temperature in the range of 100 to 180° C., at a pressure in the range of 5 to 20 kg/cm$^2$, and for a period of one hour or more. The reaction mixture after completion of the reaction is distilled at atmospheric or reduced pressure to remove the unreacted compounds. The quaternary ammonium inorganic acid salts synthesized in this manner can be represented by the following general formula (1).

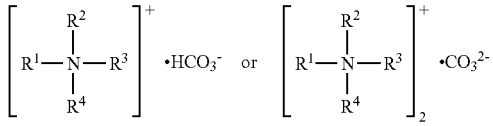

(1)

In formula (1), $R^1$, $R^2$, $R^3$, and $R^4$ are methyl or ethyl and they may be identical with or different from one another.

Of the compounds represented by formula (1), $[(CH_3)_4N]HCO_3$ and $[(C_2H_5)_4N]HCO_3$ are preferred.

In the production of the quaternary ammonium inorganic acid salt in the manner described above, for example, the trialkylamine and the dialkyl carbonate are respectively refined by distillation, submitted to the aforementioned synthesis to give the quaternary ammonium inorganic acid salt, the reaction product is dissolved in water to form an aqueous solution, the aqueous solution is supplied to the anode chamber in an electrolytic cell partitioned by an anion exchange membrane, and a direct current voltage is applied to perform the electrolysis. During the electrolysis, quaternary ammonium ions migrate through the cation exchange membrane to the cathode chamber and the quaternary ammonium hydroxide is formed in the cathode chamber. At this time, oxygen and carbon dioxide evolve from the anode while hydrogen evolves from the cathode. A durable fluorocarbon-based exchange membrane or an inexpensive polystyrene- or polypropylene-based exchange membrane may be used as the aforementioned cation exchange membrane.

The electrode for electrolysis provided by this invention is inserted into the electrolytic cell as an anode. This electrode comprises an electrode base material of an electrically conductive metal, an electrode active layer containing an electrode active material covering the electrode base material, and an intermediate layer of a mixed oxide of an oxide of at least one kind of metal selected from In, Ir, Ta, Ti, Ru, and Nb, preferably from In, Ir, and Ta, and an oxide of Sn disposed between the electrode base material and the electrode active layer. An electrode provided with the intermediate layer thus made of a mixed oxide of an oxide of at least one kind of metal selected from In, Ir, Ta, Ti, Ru, and Nb and an oxide of Sn develops close adhesion between the electrode and the electrode active layer due to the synergistic effect of the mixed oxides of Sn and other metals and, as a result, shows excellent corrosion resistance and an ability to endure sustained use in electrolysis. Concrete examples of the oxides of metals selected from In, Ir, Ta, Ti, Ru, and Nb are $In_2O_3$, $Ir_2O_3$, $IrO_2$, $Ta_2O_5$, $TiO_2$, $Ru_2O_3$, and $NbO_2$. Of these metal oxides, $In_2O_3$, $Ir_2O_3$, and $Ta_2O_5$ are preferred and $In_2O_3$ or $Ir_2O_3$ is more preferred for its excellent electrical conductivity. On the other hand, SnO and $SnO_2$ are cited as concrete examples of the oxides of Sn and $SnO_2$ is preferred. That is, a mixed oxide desirable for the formation of the intermediate layer in this invention is a mixture of an oxide of at least one kind of metal selected from In, Ir, Ta, Ti, Ru, and Nb and $SiO_2$ and concrete examples of the mixed oxides are $In_2O_3 \cdot SnO_2$, $Ir_2O_3 \cdot SnO_2$, $Ta_2O_5 \cdot SnO_2$, $In_2O_3 \cdot Ir_2O_3 \cdot SnO_2$, $In_2O_3 \cdot Ta_2O_5 \cdot SnO_2$, $Ir_2O_3 \cdot Ta_2O_5 \cdot SnO_2$, and $In_2O_3 \cdot Ir_2O_3 \cdot Ta_2O_5 \cdot SnO_2$. More preferred are $In_2O_3 \cdot SnO_2$, $Ir_2O_3 \cdot SnO_2$, and $In_2O_3 \cdot Ir_2O_3 \cdot SnO_2$.

The content of the oxide of Sn in terms of metal in the mixed oxides forming the intermediate layer is 50 to 80 wt %, preferably 60 to 70 wt %. An electrode with an Sn content of less than 50 wt % may encounter problems in corrosion resistance and durability while an electrode with an Sn content in excess of 80 wt % may suffer from a rise of overvoltage. A mixture of the oxides of Sn and other metals in which Sn accounts for 60 to 70 wt % exhibits a desirable characteristic from the viewpoint of electrical conductivity and strength of coating film.

The thickness of the intermediate layer in this invention is 3 to 100 μm, preferably 10 to 40 μm. When the thickness of the intermediate layer is less than 3 μm, there is the possibility that pinholes are formed in the film, the electrode base material is oxidized, the potential rises during electrolysis, and the electric current flows with difficulty. On the other hand, when the thickness is more than 100 μm, there is the possibility that the film strength decreases due to the relationship in thermal expansion between the electrode base material and the intermediate layer. The thickness in the range of 10 to 40 μm is desirable from the viewpoint of film strength, durability, and current/voltage. The intermediate layer in this invention may be a single layer of a mixed oxide or a laminate of two or more layers of a mixed oxide.

An electrode active layer containing a platinum group metal such as Pt, Ru, Pd, and Ir, a metal such as In and Sn, or an oxide of the foregoing metals may be cited as an example of the electrode active layer in this invention. However, an electrode active layer of a mixed oxide of an oxide of at least one kind of metal selected from Ir or In and an oxide of Sn is preferable as it closely adheres to the intermediate layer, shows good electrical conductivity, and keeps the electrolytic potential and electric power consumption at an adequate level when used in an electrode. In the case where the electrode active layer is made of a mixed oxide of an oxide of at least one kind of metal selected from Ir or In and an oxide of Sn, the oxides of Ir and In cited above in the explanation of the intermediate layer may also be cited as concrete examples here and, likewise, $SnO_2$ in the case of Sn oxide.

When the aforementioned electrode active layer is made of a mixed oxide of an oxide of at least one kind of metal selected from Ir or In and an oxide of Sn, the content of Sn in the mixed oxide forming this electrode active layer is 50 to 80 wt %, preferably 60 to 70 wt %, in terms of metal. An electrode active layer with an Sn content of less than 50 wt % may encounter problems in the film strength and electrical conductivity. On the other hand, an electrode active layer with an Sn content in excess of 80 wt % may suffer a decrease in the film strength and, moreover, there is the possibility that the voltage rises and the electric current flows with difficulty when it is used in an electrode. When the content of Sn is in the range of 60 to 70 wt %, the mixed oxide forming the electrode active layer excels in the electrical conductivity and film strength.

The thickness of the electrode active layer in this invention is 3 to 40 μm, preferably 5 to 20 μm. An electrode active layer with a thickness of less than 3 μm shows inferior current characteristic and the one with a thickness in excess of 40 μm may suffer a decrease in the film strength from the viewpoint of adhesion to the intermediate layer. The electrode active layer in this invention may be a single layer of a mixed oxide containing an electrode active material or a laminate of two or more layers of a mixed oxide.

It is possible to use one kind of metal or an alloy of two kinds or more of metals selected from Ti, Ta, Nb, and Zr as an electrode base material of an electrically conductive metal in this invention and, in consideration of the economics, Ti is used preferably for its ready commercial availability at low cost.

No specific restriction is imposed on the method for producing an electrode for electrolysis according to this invention. An example of the method is described below.

An electrically conductive metal (Ti) as an electrode base material is degreased by acetone, then surface-treated with hydrochloric acid of the prescribed concentration at 90 to 100° C. for 5 to 30 minutes, and washed thoroughly with pure water. Chlorides of tin (Sn), iridium (Ir), and indium (In) are dissolved in an alcohol such as butanol and propanol to the concentration prescribed for each chloride and the resulting solution (a mixed solution) is applied to the surface of the surface-treated electrode base material, the electrode base material thus coated is dried in the atmosphere at 80 to 100° C. for a period of 30 to 60 minutes, and then decomposed by heating in the atmosphere at 450 to 500° C. for a period of 10 to 30 minutes to form a film of a mixed oxide of an oxide of Sn, an oxide of Ir, and an oxide of In on the surface of the electrode base material. This procedure for forming the film of a mixed oxide is repeated two to four times to form an intermediate layer with a thickness of 3 to 30 μm on the surface of the electrode base material When the mixed solution is applied to the surface of the electrode base material as a first coat to form the intermediate layer, it is allowable to dissolve a chloride of Ta in an alcohol such as butanol and propanol, add the alcoholic solution to the aforementioned mixed solution, apply the mixed solution containing the chloride of Ta to the surface of the electrode base material, and perform the aforementioned drying and thermal decomposition. The inclusion of the oxide of Ta in the film of the mixed oxide to be formed first on the surface of the electrode base material improves the adhesion of the intermediate layer to the electrode base material. It is also allowable to use the mixed solution containing the chloride of Ta as a second coat and after in the formation of the mixed oxide film. However, the oxide of Ta ($Ta_2O_5$) shows low electrical conductivity and it is preferable to include the Ta oxide in the first coat in the formation of the intermediate layer on the surface of the electrode base material.

Following this, the chlorides of Sn, Ir, and In are dissolved in an alcohol such as butanol and propanol respectively to the prescribed concentration, the solution (mixed solution) is applied to the electrode base material on which the intermediate layer has been formed, and dried and thermally decomposed to form an electrode active layer with a film thickness of 5 to 20 μm while repeating this procedure two to four times as in the formation of the intermediate layer. The electrode for electrolysis of this invention is obtained in this manner.

Supposing that the intermediate layer and the electrode active layer formed on the surface of the electrode base material are collectively referred to as the surface coating layer, it is preferable to control the content of respective oxide in the total mixed oxide (the mixed oxide forming the intermediate layer and the mixed oxide forming the electrode active layer) forming the surface coating layer as follows in terms of metal: Sn, 50 to 80 wt %; Ir, 10 to 30 wt %; In, 3 to 15 wt %; and Ta, 0.5 to 3 wt %. More preferably, the content is as follows: Sn, 60 to 70 wt %, Ir, 10 to 20 wt %, In, 5 to 10 wt %; and Ta 0.5 to 1.0 wt %.

The problems relating to Sn have already been described above. In the case of Ir, a content of less than 10 wt % causes problems in electrical conductivity and current value while a content of more than 30 wt % may cause a problem in the film strength of the mixed oxide. A content of Ir in the range of 10 to 20 wt % is more preferable on the basis of the electric characteristics of the mixed oxide for forming the surface coating layer, namely, the current/voltage relationship. In the case of In, a content of less than 3 wt % causes problems in electrical conductivity with a possible rise of voltage while a content in excess of 15 wt % produces the possibility of the film strength of the mixed oxide decreasing and a content of In in the range of 5 to 10 wt % is more preferable from the viewpoint of film strength, electrical conductivity, and durability. In the case of Ta, a content of less than 0.5 wt % fails to manifest the synergistic effect in adhesion to the electrode base material while a content in excess of 3 wt % causes a problem in electrical conductivity and produces the possibility of the voltage rising during electrolysis.

In application of the electrode for electrolysis obtained above to the production of a quaternary ammonium hydroxide by the electrolysis of a quaternary ammonium inorganic acid salt in an electrolytic cell partitioned by a cation exchange membrane, the conditions for the electrolysis may be selected appropriately and an example is shown below. An aqueous solution of a quaternary ammonium inorganic acid salt such as tetramethylammonium hydrogen carbonate and tetramethylammonium carbonate is supplied to the anode chamber in the electrolytic cell so that its concentration becomes 10 to 50 wt %, preferably 15 to 30 wt %, and pure water is supplied to the cathode chamber. Pure water to which a suitable amount (3-15 wt %) of a quaternary ammonium hydroxide is added is used preferably here. The solutions in the anode and cathode chambers are respectively supplied by circulation and the electrolysis is performed at a current density of 8 to 20 A/dm$^2$, preferably 10 to 15 A/dm$^2$, for a retention time of 10 to 60 seconds, preferably 20 to 40 seconds, for respective solution in the anode and cathode chambers until the concentration of the quaternary ammonium hydroxide in the cathode chamber reaches 5 to 30 wt %, preferably 10 to 25 wt %. The cathode to be inserted into the aforementioned electrolytic cell is not restricted and alkali-resistant stainless steel or nickel may be used as such.

Effect of the Invention

The electrode for electrolysis of this invention comprises an intermediate layer which is formed by a mixed oxide mainly consisting of an oxide of Sn and adheres closely to the electrode base material. Therefore, it can be used as an anode in the electrolysis of a quaternary ammonium inorganic acid salt in an electrolytic cell partitioned by a cation exchange membrane over a prolonged period of time with excellent durability and corrosion resistance. Moreover, the electrode for electrolysis of this invention is capable of reducing the overvoltage and electric power consumption in an electrolytic process in which oxygen and carbon dioxide evolve and it is suitable for the production of a high-purity quaternary ammonium hydroxide on a commercial scale at low cost. Still more, this electrode used as an anode in the production of a quaternary ammonium hydroxide by electrolysis reduces the elution of impurity metals as much as possible and allows the production of a high-purity quaternary ammonium hydroxide on a commercial scale at low cost.

PREFERRED EMBODIMENTS OF THE INVENTION

Figure 1:
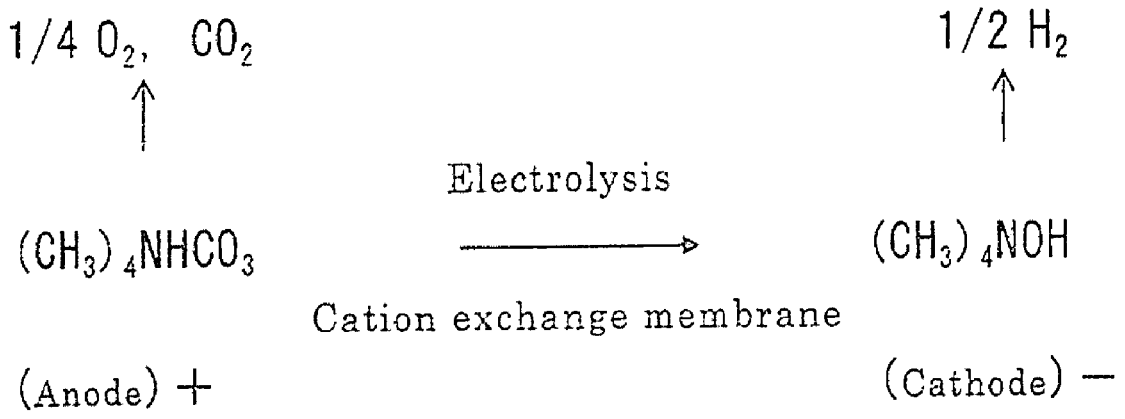
FIG. 1 outlines the electrolytic process relating to this invention.

This invention will be described concretely below with reference to the accompanying examples and comparative examples.

Example 1

Preparation of Electrode for Electrolysis

A commercially available Ti plate measuring 2.0 mm×10 cm x6 cm was degreased with acetone and then submitted to an etching treatment by immersing in a 20 wt % aqueous solution of hydrochloric acid at 100° C. for 5 to 10 minutes to prepare an electrode base material. Following this, an aqueous solution of tin chloride containing 30 g of Sn per 100 ml and an aqueous solution of indium chloride ($InCl_3$) containing 10 g of In per 100 ml were prepared and the two aqueous solutions were dissolved in butanol to give a mixed solution with the total volume made up to 500 ml. The mixed solution was applied to the surface of the aforementioned electrode base material, dried in the atmosphere at 100° C. for 10 minutes, placed in an electric furnace whose temperature is kept at 450° C., and thermally decomposed in the atmosphere for 10 minutes. A series of treatments consisting of coating, drying, and thermal decomposition of the mixed solution was repeated four times in total to form an intermediate layer with a thickness of 6 μm on the electrode base material. It is to be noted that an aqueous solution of Ta chloride (TaCls) containing 1.0 of Ta per 100 ml was added to the aforementioned aqueous solutions of tin chloride and indium chloride, and the mixed solution was dissolved in butanol with the total volume made up to 500 ml and used only in the first of a plurality of runs in performing the series of treatments.

Following this, an aqueous solution of tin chloride containing 20 g of Sn per 100 ml and an aqueous solution of iridium chloride ($IrCl_3$) containing 5 g of Ir per 100 ml were prepared, both of these solutions were dissolved in butanol with the total volume made up to 500 ml, and the resulting mixed solution was applied as an electrode active material to the aforementioned electrode base material, dried in the atmosphere at 100° C. for 10 minutes, placed in an electric furnace whose temperature is kept at 450° C., and thermally decomposed in the atmosphere for 10 to 15 minutes. A series of treatments consisting of coating, drying, and thermal decomposition of the mixed solution was conducted four times in total to form an electrode active layer with a thickness of approximately 20 μm on the surface of the intermediate layer. An electrode for electrolysis was produced in this manner.

At the time when the intermediate layer was formed on the surface of the electrode base material in the production of the aforementioned electrode for electrolysis, the intermediate layer was analyzed for the metals with an X-ray fluorescence spectrometer (SEA2210 available from Shimadzu Corporation) to determine the kind and content of the oxides contained in the mixed oxide forming the layer in question. Likewise, a similar measurement was made at the time when the electrode active layer was formed. The results are shown in Table 1.

Moreover, the composition of the mixed oxide (including the mixed oxide forming the intermediate layer and the mixed oxide forming the electrode active layer) forming the coating film (referring to the intermediate layer and the electrode active layer and sometimes the two layers being collectively referred to as "the surface coating layer") was determined with the aforementioned X-ray fluoroscence spectrometer. The content of metals in the mixed oxide forming the surface coating layer is shown in Table 1.

TABLE 1

| | Electrode for electrolysis | | | |
|---|---|---|---|---|
| | Electrode | Surface coating layer | | Metals in mixed oxide forming |
| | base material | Intermediate layer | Electrode active layer | surface coating layer (Unit: wt %) |
| Example 1 | Ti | $SnO_2$—$InO_2$ ($SnO_2$:$InO_2$ = 75:25) | $SnO_2$—$IrO_2$ ($SnO_2$:$IrO_2$ = 80:20) | Ti = 19, Sn = 56, Ir = 17, In = 7, Ta = 0.1 |
| Example 2 | Ti | $SnO_2$—$InO_2$ ($SnO_2$:$InO_2$ = 70:30) | $SnO_2$—$IrO_2$ ($SnO_2$:$IrO_2$ = 70:30) | Ti = 4, Sn = 68, Ir = 15, In = 8, Ta = 0 |
| Comparative example 1 | Ti | $TiO_2$—$IrO_2$—$Ta_2O_5$ ($TiO_2$:$IrO_2$:$Ta_2O_5$ = 15:60:25) | | Ti = 31, Ir = 4.6, Ta = 19 |
| Comparative example 2 | Ti | Pt | | — |
| Comparative example 3 | Ti | Au | | — |
| Comparative example 4 | C | C | | — |

[Electrolysis Using the Electrode for Electrolysis]

Using an electrolytic cell of the single cell type comprising the aforementioned electrode for electrolysis as an anode, a commercially available Ni plate measuring 2.0 mm×10 cm×6 cm as a cathode, and a cation exchange membrane (Nafion 324: registered tradename of DuPont) arranged as a partition membrane in the center, seven liters of a 30 wt % aqueous solution of tetramethylammonium hydrogen carbonate was placed in the anode chamber, one liter of a 3 wt % aqueous solution of tetramethylammonium hydroxide (TMAH) was placed in the cathode chamber, and the electrolysis was conducted with continuous circulation of the aqueous solutions in the anode and cathode chambers by a pump under the conditions of a voltage of 8 V, a current of 1.7 A, and an effective electrolytic area of 16 $cm^2$ for the cation exchange membrane for a period of 600 hours to produce 5.3 kg of a 25 wt % aqueous solution of TMAH in the cathode chamber. After the electrolysis, the aqueous solution in the anode chamber was a 5.1 wt % aqueous solution of tetramethylammonium hydrogen carbonate amounting to 2.3 liters.

Visual observation of the appearance of the electrode (anode) for electrolysis upon completion of the electrolysis detected no change worth mentioning in the anode itself and the aqueous solution in the anode chamber. Moreover, the electrode (anode) for electrolysis was weighed before and 600 hours after the electrolysis and no noticeable change was found. When the electrode (anode) for electrolysis was used twice more for a total of three times (600 hours×3=1800 hours) in the electrolysis under the aforementioned conditions, no change was observed in the appearance (of the anode itself and the aqueous solution in the anode chamber) and in the weight as shown in Table 2. The metal impurities in the aqueous solutions in the anode and cathode chambers after the electrolysis were analyzed with an atomic absorption spectrometer (a product of Varian, Inc.) to see the extent of elution of the metal impurities. The analytical results are shown in Table 3 for the aqueous solution in the anode chamber and in Table 4 for the aqueous solution (TMAH) in the cathode chamber.

TABLE 2

| | Electrolysis time (hour) | Electrolytic voltage*1 (V) | Current (A) | Condition of anode | |
|---|---|---|---|---|---|
| | | | | Appearance | Change in weight |
| Example 1 | 600 × 3 | 8 | 1.7 | No change | No change |
| Example 2 | 600 × 3 | 9 | 1.7 | No change | No change |
| Comparative example 1 | 100 | 10 | 1.7 | Some change | Some change |
| Comparative example 2 | 100 | 12 | 1.7 | No change | Some change |
| Comparative example 3 | 10 minutes*2 | 13 | 1.7 | Peeling of plated film*2 | Some change*2 |
| Comparative example 4 | 500 | 1.4 | 1.7 | Decrease in thickness from 10 mm to 7 mm | |

*1The electrolytic voltage was measured midway in the electrolysis.

*2The gold film peeled off 10 minutes after the start of electrolysis and this made it impossible to continue the electrolysis.

TABLE 3

| Analytical results of the aqueous solutions in the anode chamber (after electrolysis) | | | | | | | | | | | |
|---|---|---|---|---|---|---|---|---|---|---|---|
| | Metal impurities (Unit: ppb) | | | | | | | | | | |
| | Na | K | Ti | Ir | Sn | In | Fe | Ni | Ta | Pt | Au |
| Example 1 | 0.1 | 0.2 | 0.5 | 0.1 | 0.1 | 0.2 | 0.1 | 0.1 | 0.1 | — | — |
| Example 2 | 0.2 | 0.3 | 0.4 | 0.1 | 0.3 | 0.3 | 0.4 | 0.3 | 0.1 | — | — |
| Comparative example 1 | 0.4 | 0.5 | 0.6 | $0.3 \times 10^4$ | 0.1 | 0.1 | <0.5 | 0.5 | $0.2 \times 10^4$ | — | — |
| Comparative example 2 | 0.4 | 0.1 | 0.7 | — | — | — | <0.5 | — | — | 50 | — |
| Comparative example 3 | | | | | | *1 | | | | | |
| Comparative example 4 | | | | | | *2 | | | | | |

*1: The gold film peeled off completely from the surface of the electrode base material 10 minutes after start of electrolysis and this made the analysis impossible.
*2: Carbon separated excessively in the aqueous solution in the anode chamber and the analysis was not made.

TABLE 4

| Analytical results of the aqueous solution in the cathode chamber (after electrolysis) | | | | | | | | | | | |
|---|---|---|---|---|---|---|---|---|---|---|---|
| | Metal impurities (Unit: ppb) | | | | | | | | | | |
| | Na | K | Ca | Ti | Ir | Sn | In | Ta | Pt | Au | C |
| Example 1 | 0.2 | 0.2 | 0.1 | 0.4 | <0.1 | <0.1 | <0.1 | <0.1 | — | — | — |
| Example 2 | <0.1 | 0.2 | 0.2 | <0.1 | <0.1 | <0.1 | <0.1 | <0.1 | — | — | — |
| Comparative example 1 | — | — | — | — | 210 | — | — | 60~70 | — | — | — |
| Comparative example 2 | — | — | — | — | — | — | — | — | <2 | — | — |
| Comparative example 3 | — | — | — | — | — | — | — | — | — | <0.1 | — |
| Comparative example 4 | — | — | — | — | — | — | — | — | — | — | none |

Example 2

An electrode for electrolysis was produced as described in Example 1 while controlling the kind and content of the oxides in the respective mixed oxide forming the intermediate layer and the electrode active layer as shown in Table 1. The mixed solution for forming the intermediate layer was prepared by dissolving an aqueous solution of tin chloride containing 30 g of Sn per 100 ml and an aqueous solution of indium oxide ($InCl_3$) containing 3 g of In per 100 ml in butanol with the total volume made up to 500 ml and the mixed solution for forming the electrode active layer was prepared by dissolving an aqueous solution of tin chloride containing 32 g of Sn per 100 ml and an aqueous solution of iridium chloride ($IrCl_3$) containing 5 g of Ir per 100 ml in butanol with the total volume made up to 500 ml. The electrode for electrolysis thus obtained was analyzed with an X-ray fluorescence spectrometer as in Example 1 (Table 1). The aqueous solution of chlorides containing Ta used in the formation of the intermediate layer in Example 1 was not used in Example 2.

Using this electrode for electrolysis as an anode, the electrolysis was conducted for 600 hours as in Example 1. Visual observation of the electrode (anode) for electrolysis after the electrolysis detected no change in the anode itself and the aqueous solution in the anode chamber and, moreover, the weight of the electrode (anode) for electrolysis showed no change before and after the electrolysis. The metal impurities in the aqueous solutions in the anode and cathode chambers after the electrolysis were analyzed with an atomic absorption spectrometer as in Example 1 to see the extent of elution of the metal impurities. The analytical results are shown in Table 3 for the aqueous solution in the anode chamber and in Table 4 for the aqueous solution (TMAH) in the cathode chamber.

Comparative Example 1

A commercially available Ti plate was submitted to the etching treatment as in Example 1. An aqueous solution of iridium chloride ($IrCl_3$) containing 15 g of Ir per 100 ml and an aqueous solution of tantalum chloride ($TaCl_5$) containing 5 g of Ta per 100 ml were prepared and both of them were dissolved in butanol with the total volume made up to 500 ml. This mixed solution was applied to the surface of the electrode base material, a series of treatments consisting of coating, drying and thermal decomposition of the mixed solution was repeated five times in total under the same conditions as in Example 1 to form a coating layer with a thickness of approximately 10 μm on the surface of the electrode base material. An electrode for electrolysis was produced in this manner.

With the sole exception of using this electrode as an anode, the electrolysis was conducted for 100 hours in the same electrolytic cell with supply of the same aqueous solutions to the anode and cathode chambers as in Example 1.

Visual observation of the electrode (anode) for electrolysis after the electrolysis as in Example 1 indicated that the surface of the anode turned white and the Ti plate was partly exposed. Moreover, it was confirmed that the aqueous solution in the anode chamber was colored blue. Still more, the anode suffered a loss of approximately 0.02 g in weight after the electrolysis and the electrolytic voltage rose by 1 to 2 V after 100 hours of electrolysis (Table 2). The metal impurities in the aqueous solutions in the anode and cathode chambers after the electrolysis were analyzed as in Example 1 and the analytical results are shown in Table 3 for the aqueous solution in the anode chamber and in Table 4 for the aqueous solution in the cathode chamber.

Comparative Example 2

A commercially available Ti plate was submitted to the etching treatment as in Example 1. The Ti plate was plated in the usual manner with a 0.1 μm-thick platinum film to give an electrode. With the sole exception of using the electrode of Comparative Example 2 as an anode, the electrolysis was conducted for 100 hours in the same electrolytic cell with supply of the same aqueous solutions to the anode and cathode chambers as in Example 1

Visual observation of the electrode (anode) for electrolysis after the electrolysis as in Example 1 showed no change in the anode itself and the aqueous solution in the anode chamber. However, the elution of Pt (50 ppb) was confirmed 5 hours after the start of electrolysis and the anode suffered a loss of approximately 0.02 g in weight. Moreover, after 100 hours of electrolysis, the electrolytic voltage rose by 6 to 10 V from the level at the start of electrolysis (Table 2). The metal impurities in the aqueous solutions in the anode and cathode chambers were analyzed after the electrolysis as in Example 1 and the analytical results are shown in Table 3 for the aqueous solution in the anode chamber and in Table 4 for the aqueous solution in the cathode chamber.

Comparative Example 3

A commercially available Ti plate was submitted to the etching treatment as in Example 1 and then plated in the usual manner with a 0.1 μm-thick gold film to give an electrode. With the sole exception of using the electrode of Comparative Example 3 as an anode, the electrolysis was conducted for 100 hours in the same electrolytic cell with supply of the same aqueous solutions to the anode and cathode chambers as in Example 1. The gold film started peeling off the anode a moment after the start of electrolysis and peeled off nearly completely in approximately 10 minutes and the electrolysis was stopped thereafter. The metal impurities in the aqueous solutions in the anode and cathode chambers were analyzed at this point as in Example 1 and the analytical results are shown in Table 3 for the aqueous solution in the anode chamber and in Table 4 for the aqueous solution in the cathode chamber. It was unable to make measurement on the aqueous solution in the anode chamber because of the peeling off of the gold film from the anode.

Comparative Example 4

An electrode was prepared from a carbon plate with a purity of 99.9% by cutting the plate to a size measuring 10 mm×10 cm×10 cm and submitting it twice to an etching treatment which consists of cleaning with 10 wt % hydrochloric acid at 90° C. With the sole exception of using the carbon electrode of Comparative Example 4 as an anode, the electrolysis was conducted for 500 hours in the same electrolytic cell with supply of the same aqueous solutions to the anode and cathode chambers as in Example 1.

The aqueous solution in the anode chamber was dark and turbid after the electrolysis and the thickness of the anode decreased from 10 mm before the electrolysis to 7 mm after the electrolysis (Table 2). The metal impurities in the aqueous solutions in the anode and cathode chambers were analyzed after the electrolysis as in Example 1 and the analytical results are shown in Table 3 for the aqueous solution in the anode chamber and in Table 4 for the aqueous solution in the cathode chamber. The aqueous solution in the anode chamber was not analyzed because of excessive consumption of the anode.

Industrial Applicability

The electrode for electrolysis of this invention shows excellent durability and corrosion resistance as it comprises an intermediate layer which is formed of a mixed oxide primarily consisting of an oxide of Sn and adheres closely to an electrode base material and the electrode can be used as an anode in the electrolysis of a quaternary ammonium inorganic acid salt in an electrolytic cell partitioned by a cation exchange membrane over a prolonged period of time. Further, the electrode for electrolysis of this invention minimizes a rise of overvoltage and reduces electric power consumption in an electrolytic process in which oxygen and carbon dioxide evolve and allows the production of a high-purity quaternary ammonium hydroxide on a commercial scale at low cost. The product quaternary ammonium hydroxide is suitable for use as a developer in the manufacture of LSI's and liquid crystal displays and as a cleaning fluid for semiconductor substrates (wafers).

What is claimed is:

1. A method for producing an aqueous solution of a quaternary ammonium hydroxide which comprises the steps of:

synthesizing a quaternary ammonium inorganic acid salt by the reaction of a trialkylamine with a dialkyl carbonate; and electrolyzing the inorganic acid salt in an electrolytic cell partitioned by a cation exchange membrane with the use of an electrode for electrolysis, wherein the electrode comprises:

an electrode base material of an electrically conductive metal of a metal selected from the group consisting of Ti, Ta, Nb and Zr or an alloy of at least one metal selected from the group consisting of Ti, Ta, Nb and Zr;

an electrode active layer of a mixed oxide of an oxide of Sn and an oxide of at least one metal selected from the group consisting of In and Ir covering the electrode base material; and an intermediate layer of a mixed oxide of an oxide of Sn and an oxide of at least one metal selected from the group consisting of In and Ir disposed between the electrode base material and the electrode active layer, wherein a content of Sn in the mixed oxide forming the electrode active layer is 50-80% by weight, a content of Sn in the mixed oxide forming the intermediate layer is 50-80% by weight, and the mixed oxide of the intermediate layer further contains an oxide of at least one metal selected from the group consisting of Ti, Ta and Nb, and the mixed oxide of the electrode active layer does not contain essentially an oxide of an oxide of the electrically conductive metal.

2. The method as described in claim 1, wherein the quaternary ammonium inorganic acid salt is a compound represented by the following general formula (1)

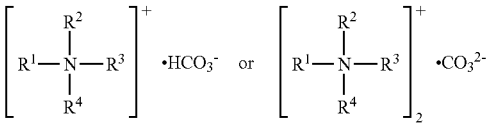

(1)

wherein $R^1$, $R^2$, $R^3$, and $R^4$ are methyl or ethyl and they may be identical with or different from one another.

3. The method as described in claim 1, wherein the quaternary ammonium hydroxide is tetramethylammonium hydroxide.

4. The method as described in any one of claims 1, 2, and 3, wherein the electrode base material is either the electrically conductive metal of Ti or the electrically conductive metal of alloy of Ti.

5. The method as described in claim 4, wherein the mixed oxide of the electrode active layer is the oxide of Sn and the oxide of Ir.

6. The method as described in claim 4, wherein the mixed oxide of the intermediate layer is the oxide of Sn, the oxide of In and the oxide of Ti.

7. A method for producing an aqueous solution of a quaternary ammonium hydroxide which comprises the steps of:

synthesizing a quaternary ammonium inorganic acid salt by the reaction of a trialkylamine with a dialkyl carbonate; and electrolyzing the inorganic acid salt in an electrolytic cell partitioned by a cation exchange membrane with the use of an electrode for electrolysis, wherein the electrode comprises:

an electrode base material of an electrically conductive metal of a metal selected from the group consisting of Ti, Ta, Nb and Zr or an alloy of at least one metal selected from the group consisting of Ti, Ta, Nb and Zr;

an electrode active layer of a mixed oxide of an oxide of Sn and an oxide of at least one metal selected from the group consisting of In and Ir covering the electrode base material; and an intermediate layer of a mixed oxide of an oxide of Sn and an oxide of at least one metal selected from the group consisting of In and Ir disposed between the electrode base material and the electrode active layer, wherein a content of Sn in the mixed oxide forming the electrode active layer is 50-80% by weight, a content of Sn in the mixed oxide forming the intermediate layer is 50-80% by weight, the mixed oxide of the intermediate layer further contains an oxide of at least one metal selected from the group consisting of Ti, Ta and Nb, and the mixed oxide of the electrode active layer consists essentially of the oxide of Sn and the oxide of at least one metal selected from the group consisting of In and Ir.

* * * * *